United States Patent [19]

Lippman

[11] Patent Number: 4,765,515

[45] Date of Patent: Aug. 23, 1988

[54] LIQUID DISPENSING COMBINATION

[76] Inventor: Jerome Lippman, 3342 W. Smith Rd., Akron, Ohio 44313

[21] Appl. No.: 856,790

[22] Filed: Apr. 28, 1986

[51] Int. Cl.[4] ..... B67D 5/64

[52] U.S. Cl. ..... 222/162; 222/180

[58] Field of Search ..... 222/160, 162, 180, 182; 239/274, 302

[56] References Cited

U.S. PATENT DOCUMENTS

| | | | |
|---|---|---|---|
| 1,118,977 | 12/1914 | Watrous | 222/180 |
| 1,487,674 | 3/1924 | Starbird | 222/180 |
| 2,904,223 | 9/1959 | Ryan | 222/162 |
| 2,966,283 | 12/1960 | Darvie | 222/160 |
| 2,998,822 | 9/1961 | Birch et al. | 222/162 |
| 3,130,873 | 4/1964 | Klutz | 222/182 |
| 3,216,625 | 11/1965 | Corsette | 222/182 |
| 3,344,959 | 10/1967 | Faso | 222/162 |
| 3,741,439 | 6/1973 | Vehrs | 222/103 |
| 3,881,641 | 5/1975 | Pliml, Jr. et al. | 222/207 |
| 4,256,242 | 3/1981 | Christine | 222/207 |
| 4,280,638 | 7/1981 | Keihm | 222/180 |
| 4,286,735 | 9/1981 | Sneider | 222/189 |
| 4,314,658 | 2/1982 | Laauwe | 222/213 |
| 4,336,895 | 6/1982 | Aleff | 222/207 |
| 4,352,443 | 10/1982 | Libit | 222/207 |
| 4,375,266 | 3/1983 | Magers | 222/321 |
| 4,402,432 | 9/1983 | Corsette | 222/321 |

*Primary Examiner*—H. Grant Skaggs

*Attorney, Agent, or Firm*—Reese Taylor

[57] ABSTRACT

A liquid dispensing combination includes a mounting unit having a base and a cover. A dispensing unit including a supply reservoir and a spring load pump and nozzle is supported on the base and has a portion which projects through and is accessible from the bottom of the base and cover so that the dispensing unit can be moved upwardly relatively of the mounting unit to depress the pump and dispense a variably predetermined amount of the contents through the nozzle.

10 Claims, 3 Drawing Sheets

LIQUID DISPENSING COMBINATION

BACKGROUND OF THE INVENTION

This invention relates in general to dispensing combinations for dispensing liquids and relates in particular to a dispensing combination for dispensing soap or other personal care products from a replaceable cartridge or bottle received in a wall mounted mounting unit.

DESCRIPTION OF THE PRIOR ART

As noted, this invention relates to apparatus for dispensing liquids or flowable materials and in particular for dispensing liquid soap or similar skin care products, although the inventive concepts disclosed could be applied to the dispensing of other liquids as well.

In the prior art, the dispensing of the soap is accomplished in a variety of ways.

Perhaps one of the most common of these dispensing systems comprises a glass or plastic bottle which has a spring loaded pump and dispensing nozzle secured to its top so that, by grasping the bottle and pushing down on the pump, a measured amount of the soap is dispensed through the nozzle onto the user's hand.

Examples of such dispensing apparatus can be found in U.S. Pat. Nos. 4,280,638 Keihm; Aleff 4,336,895; Libit 4,352,443; Magers 4,375,266 and Corsette 4,402,432.

This type of arrangement is quite widely used and is effective, although it does generally require "two hand" operation for optimum effeciency, since it is generally necessary to either stabilize the bottle with one hand as the pump is activated by the other or to activate the pump with one hand and receive the soap with the other.

Liquid soaps are also commonly dispensed from a variety of mounted dispensers such as, for example, the type in which the soap is actually stored in a bag having a flexible tube projecting therefrom, with the bag being replaceably received in the dispenser and with various activating means being employed to squeeze or depress the tube, so as to eject a measured amount of the soap.

Examples of such dispensing apparatus can be found in U.S. Pat. Nos. 3,741,439 Vehrs; Pliml 3,881,641 and Christine 4,256,242.

This type of dispensing arrangement generally permits "one hand" operation in that the mechanism which collapses the tube to eject the material therefrom is generally exteriorly accessible to the user so that by engaging the activating device with the heel of the hand, a measured amount of the soap can be dispensed into the palm of the hand. This type of dispensing apparatus, while certainly effective, does involve relatively complex activating apparatus in that the various means for depressing the tube and sealing it off after a measured amount has been dispensed and refilling the tube, etc., result in an effective but relatively expensive dispensing arrangement.

It is also possible to dispense such material from a "squeeze" bottle of the type disclosed in Sneider U.S. Pat. No. 4,286,735 and Laauwe U.S. Pat. No. 4,314,658. In employing this type dispenser, the bottle is grasped in one hand, tilted and squeezed so as to dispense some of the contents onto the other hand or some other surface.

Generally then, there are a variety of known ways of dispensing soap or similar material. However, as previously noted, they either require relatively complex and expensive dispensing apparatus or two hand operation.

Additionally, when employed in areas open to the public, many of these systems are susceptible to theft or vandalism.

SUMMARY OF THE INVENTION

It is therefore an object of this invention to provide a relatively inexpensive dispensing combination for dispensing liquids, such as soaps, which includes a more or less permanently mounted mounting unit and a replaceable dispensing unit which can be mounted therein, and which can be activated by one hand to provide a simple, inexpensive but effective dispensing apparatus.

In accomplishing this object, it has been discovered that such a dispensing combination can be achieved by providing a two-piece mounting unit including a base which can be mounted to a wall or other surface and a hinged cover which is movable between open and closed positions.

It has also been found that a replaceable cartridge or dispensing unit can be provided which is supportable on the base and which has a pump attached to one end which projects through the cover when the cover is in the closed position.

In broad terms such an arrangement is similar to some of the prior art in that it includes a mounting component and a replaceable supply or dispensing unit. However, it is an object of this invention to provide such a combination wherein the activating means are carried by the supply unit; the combination is acutated from the bottom rather than the top; and the supply unit has no practical use other than in the combination.

It has thus been found in this regard that the base and the cover can be provided with mating access openings at their bottom ends so that the lower end of the dispensing or supply unit projects therethrough when the cover is closed and with the upper end thereof carrying a spring loaded pump and an associated nozzle.

It has also been found that by an arrangement such as just described, the dispensing unit can be engaged on its bottom end, which projects through the openings in the base and the cover, and moved slightly upwardly so that the pump unit contacts the top of the base thereby depressing the pump and ejecting a predetermined amount of the liquid through the nozzle onto the hand of the user.

Effectively, rather than holding the bottle or container stationary and depressing the pump, the container itself is moved to depress the pump. This enables one hand operation but also achieves the efficiency of metered dispensing and accomplishes this without provision of the relatively complex and expensive dispensing apparatus of much of the prior art.

Additionally, the dispensing or supply unit can be provided with a contoured bottom end so that it has little or no utility except in the combination to thus discourage theft or vandalism.

It accordingly becomes the principal object of this invention to provide an improved liquid dispensing combination of the character above-described with further objects thereof becoming more apparent upon a reading of the following brief specification considered and interpreted in view of the accompanying drawings.

BRIEF DESCRIPTION OF THE PREFERRED EMBODIMENT

Referring first to FIGS. 1, 2, 4 and 6, it will be noted that the improved dispensing combination, generally indicated by the numeral 10, includes a base 20 and a cover 30, which together form what will be referred to herein as the mounting unit. A cartridge or dispensing unit for holding the supply of soap is received within the mounting unit and is generally designated by the numeral 50.

Figure 4:
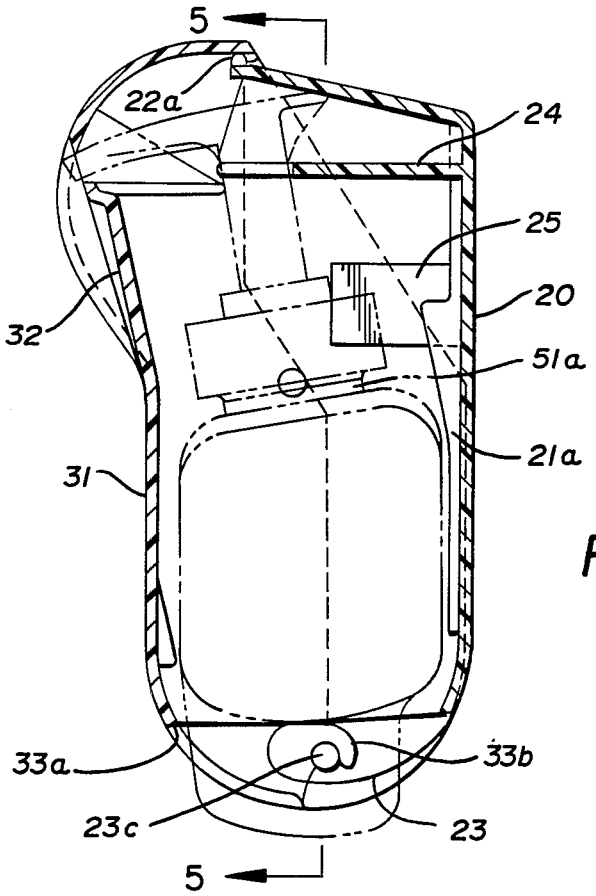
FIG. 4 is a sectional view taken along the lines 4—4 of FIG. 1.
Figure 5:
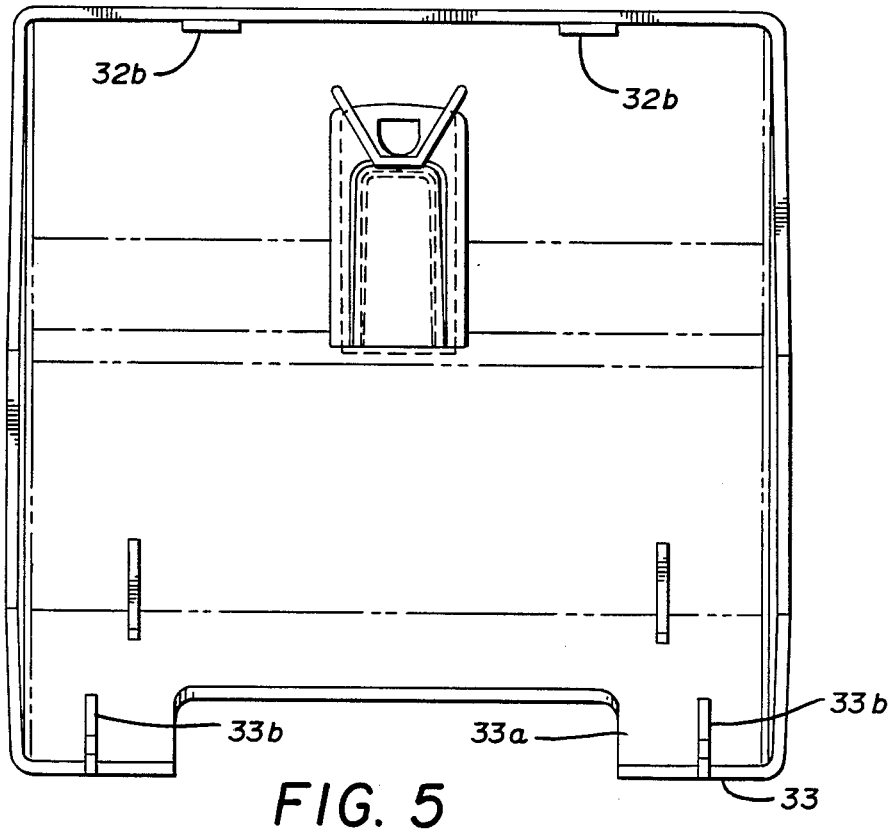
FIG. 5 is a sectional view taken along the line 5—5 of FIG. 4.
Figure 6:
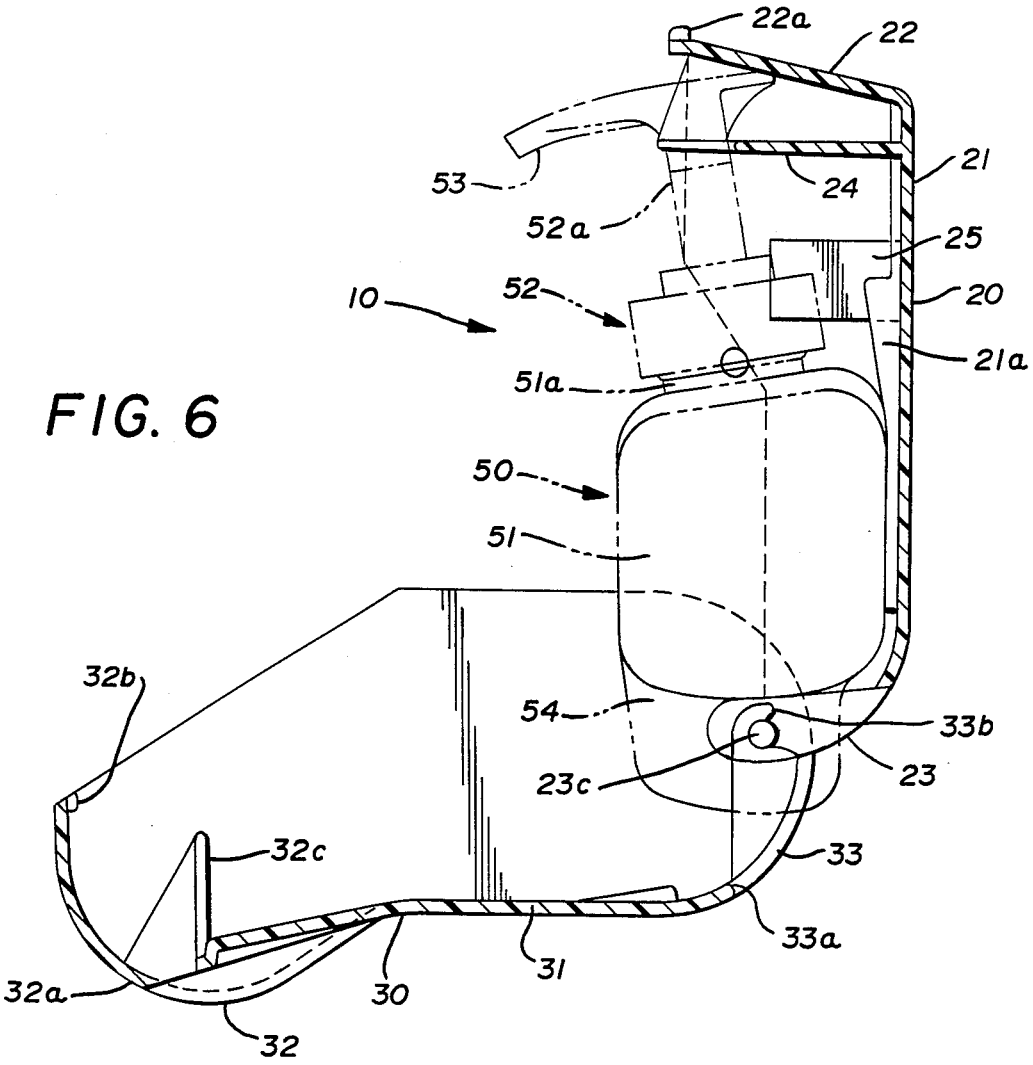
FIG. 6 is a sectional view similar to FIG. 4 showing the cover member in the open position.

Referring next to FIGS. 4 and 6 of the drawings, it will be noted that the base 20 generally includes a main body portion 21 having on its rear surface a plurality of reinforcing ribs 21*a*,21*a* and terminating in a lower arcuate bottom portion 23 having an access opening received therein and designated by the numeral 23*a*. Access opening 23*a* is of sufficient size that, when matched with a similar opening in cover 30, the bottom end of dispensing unit 50 can project therethrough as will be described. Bottom portion 23 also includes a pair of opposed projections 23*b*,23*b*, each pair of which support a bar or pin 23*c* for connection of cover 30 to base 20, as will be described.

The opposed end of the base 20 terminates in a forwardly extending top wall 22 having one or more upwardly extending latch projections 22*a* for engagement of the cover 30 as will also be described below.

Figure 1:
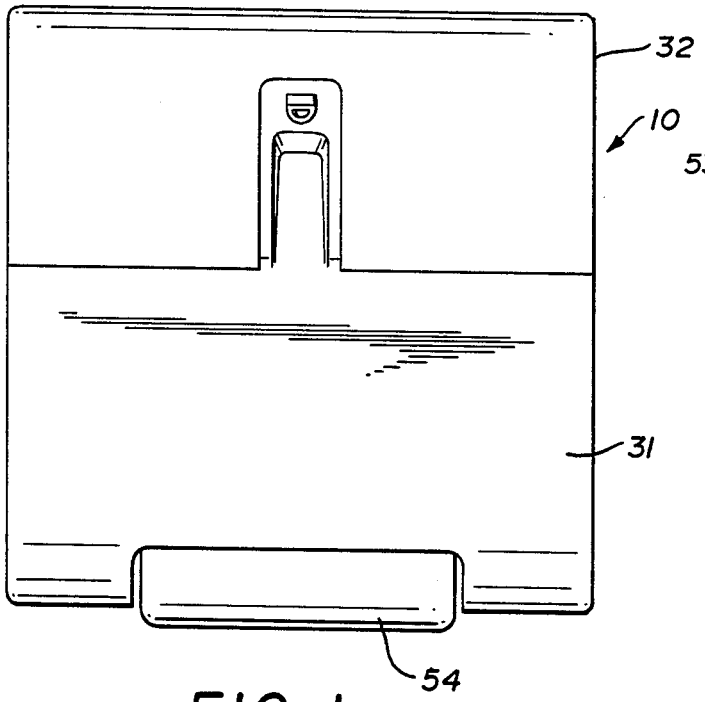
FIG. 1 is a front elevational view of the improved dispensing combination.
Figure 2:
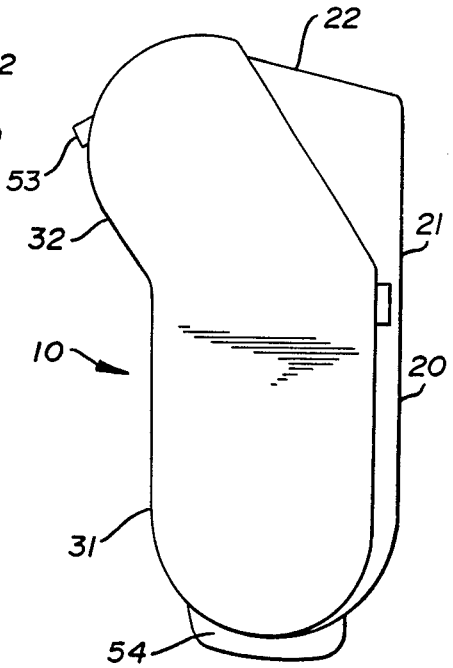
FIG. 2 is a side elevational view thereof.

Still referring to FIGS. 2, 4 and 6, the cover 30 will be seen to have a front face which includes a lower surface area 31 which, when the cover is in the closed position of FIG. 2 for example, will lie in a plane generally parallel to that of the main body portion 21 of the base 20.

Projecting upwardly and outwardly from the lower surface area 31 of the cover 30 is an upper surface area 32 which lies at an angle with respect to the plane of the lower surface 31 and which is curved back toward that plane to its ultimate lip or edge. A nozzle access opening 32*a* is received in this upper area and, on the ultimate lip area of the top portion of the cover 30, is a latch engaging member 32*b* which, when the device is in the closed position, will engage the latch projection 22*a* of the base 20 to retain the cover in the closed position as illustrated in FIGS. 2 and 4 of the drawings.

The lower surface area 31 of the cover 30 merges into an arcuate bottom 33 which has an access opening 33*a* therein so that when the cover is in the closed position of FIG. 4 for example, the access opening 33*a* will mate with the access opening 23*a* of the base 20, to form an opening for access to the bottom of dispensing unit 50 as will be described.

It will also be noted that the bottom 33 of cover 30 is hingedly connected for pivotal movement by the pins 23*c*,23*c* to the base 20, so that the cover 30 is readily movable between the closed position of FIG. 4 and the open position of FIG. 6 after disengagement of latch means 22*a* and 32*b*. In that regard, it will be noted that the cover 30 has opposed pin engaging members 33*b*,33*b* which are hook or C-shaped so as to be engagable with pins 23*c*,23*c* but which can also snap out without damage to either base 20 or cover 30 so that the unit is protected against either intentional or inadvertent damage when opened.

Also received internally of the base 20 are locating means 24 which take the form of integral projections which extend forwardly from the main body portion 21 and which are intended to engage a portion of the container 50 as will now be described.

Referring again then to FIGS. 4 and 6 of the drawing, for a description of the container or dispensing unit 50, it will be noted that the unit includes a main reservoir area 51 or bottle within which the liquid such as soap can be received. Attached to the neck 51*a* of the container is a pump assembly 52 which includes a dispensing nozzle 53. This is a spring loaded pump of the type commonly used in the industry and will not be described in great detail herein.

It will be noted, however, that the neck 51*a* is disposed at an angle with respect to the plane of the main body portion 21 when mounted (see FIGS. 4 and 6) and also lies substantially parallel to the plane of the upper surface 32 of the cover 30. This arrangement is a significant feature of the invention as will be described below.

The main reservoir area or bottle 51 terminates in a reduced width bottom portion or secondary reservoir 54 and, as can be seen in FIGS. 2, 4 and 6 of the drawings, this portion projects through the openings 23*a* and 33*a* in the base 20 and the cover 30 and has an arcuate or curved bottom contour for purposes which will be described.

In use or operation of the improved dispensing combination, it will be assumed that first the cover 30 will be opened to the position of FIG. 6. The dispensing unit 50, after having the pump freed from its locked or shipping position, will than be seated in the base 20 with its bottom portion 54 projecting through the opening 23*a* and into the opening 33*a*. This is accomplished by engaging the neck 51*a* with the locating means 24 which then retains the pump assembly 52 in a stable condition; serves to properly orient the nozzle 53 in alignment with the nozzle receiving opening 32*a* and supports the main reservoir area or bottle 51.

The cover 30 may then be closed and moved to the position of FIG. 4 of the drawings, whereupon the latch means 22*a* and 32*b* will engage so as to retain the cover in the closed position of FIG. 4. At this time, the nozzle 53 of the container 50 will project through the opening 32*a* in the cover and the bottom portion 54 of the container 50 will project through the openings 23*a* and 33*a* of the base and the cover.

To that end, ribs 32*c*,32*c* may be provided on the inside of cover 30 adjacent nozzle 53 into the opening 32*a* to further assist in directing nozzle 53 into the opening in the event of any minor remaining misalignment.

Assuming the base 21 to be mounted on a vertical surface such as a wall, in order to dispense a predetermined amount of the soap from the container it is merely necessary to engage the bottom portion 54 of the container with, for example, the fingers of the hand and push up. This will force the top of the pump assembly 52 into engagement with the top 22 of the base 20 thereby depressing the pump against its spring, opening the conventional internal valve and forcing a variably predetermined amount of the soap through the nozzle 53 and onto the palm of the hand of the user.

Also, as can be seen in FIGS. 4 and 6, the ribs 21*a*,21*a* slope outwardly from the plane of main body portion 21 so that the main reservoir or bottle portion 51 is supported during the dispensing stroke and moves upward along the axis of the pump assembly 52 which is, as previously noted, held by locating means 24.

As previously noted, the upper surface area of the cover 32 extends upwardly and outwardly from the plane of the lower surface 31 thereof. Furthermore, the container 50 has its pump assembly 52 mounted at a similar angle. This disposition is important because it makes it possible for the soap to clear the front surface of the cover 30 and be deposited on the hand of the user without dripping or running down the front surface. This, of course, enables the combination to remain clean and aesthetically appealing during use.

Furthermore it will be noted that dispensers of this type can be used in commercial establishments. While it is a fairly simple matter to open the cover and extract the container or dispensing unit 50, the container has been designed with the bottom or secondary reservoir 54 being essentially arcuate or curved in cross section so that the container will not stand alone and thus really has little or no utility, unless used in the mounting unit provided. The off center arrangement of the pump assembly 52 also contributes to this advantage and it is intended that this design will discourage theft.

To further enhance the tamper-proof characteristics of the combination, it is also possible to mount the pump assembly 54 with a commercially available closure member which is not removable without destroying the unit.

While a full and complete description of the invention has been set forth in accordance with the dictates of the patent statutes, it should be understood that modifications can be resorted to without departing from the spirit hereof or the scope of the appended claims.

In that regard, "soap" has been referred to throughout for simplicity of description, but it should be understood that the dispensing combination would have utility with other liquids as well.

Furthermore, while the bottom portion or secondary reservoir 54 of dispensing unit 50 is illustrated as arcuate or radiused other non-planar configurations could also be employed.

Additionally, it is contemplated that standard pump assemblies can be used in this combination. Since these pump assemblies dispense predetermined amounts of content such as 1 cc, 2 cc, etc. per stroke, and since the material to be dispensed will affect the desirable amount, provision is also made for adjustment by the end user. To that end, removable ribs can be mounted on the base to limit travel of the dispensing unit 50. For example, with the ribs in place, travel may be such as to dispense 1 cc, while with the ribs removed, 2 cc's may be dispensed.

Figure 3:
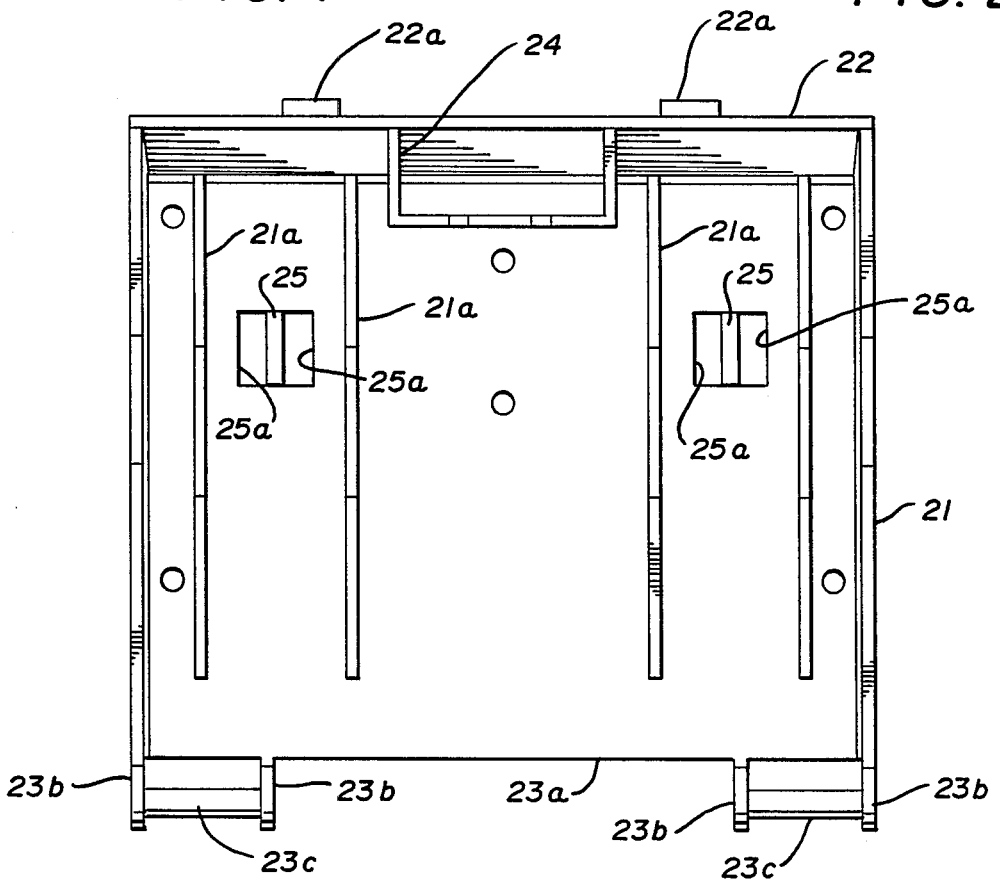
FIG. 3 is a rear elevational view thereof.

Thus, in FIGS. 3, 4 and 6 removable ribs 25,25 project from rear wall 31 so that, when bottom portion 54 of dispensing unit 50 is engaged and dispensing unit 50 is moved upwardly, the travel thereof may be limited thereby. As will be noted, the ribs 25,25 are flanked by voids *25a,25a* so that if a longer stroke is desired, they can be simply detached.

Finally, in some applications it may be possible to eliminate cover 30, extending the sidewalls of base 20 forwardly and toward each other so as to secure the dispensing unit 50 while still permitting operation of the pump as previously described.

What is claimed is:

1. A liquid dispensing combination comprising:

(A) a mounting unit including (1) a base having a planar surface and (2) a cover having a front face and a bottom surface pivotally attached to said base for movement relatively thereof between open and closed positions and having a first access opening in said front face;

(B) a dispensing unit releasably supported by said base for movement relatively thereof and including (1) a reservoir portion and (2) a dispensing portion operatively connected to said reservoir portion and partially projecting through said first access opening of said cover when said cover is in its closed position;

(C) said cover having a second access opening in its bottom surface;

(D) a part of said reservoir portion of said dispensing unit projecting through said second access opening when said dispensing unit is supported by said base; and (E) said dispensing unit being positioned by surfaces along the cover and base so as to be movable along a line parallel to a line extending from said first access opening to a point of intersection with a line extended from a plane lying along the planar surface of said base, movement of said dispensing unit toward said first access opening causing engagement of said dispensing portion with said mounting unit whereby said dispensing portion is caused to dispense liquid.

2. The dispensing combination of claim 1, wherein locating means project from one face of said base; and said dispensing portion of said dispensing unit includes a spring loaded pump secured to one end of said reservoir with said pump being releasably engagable with said locating means.

3. The dispensing combination of claim 2, wherein said first access opening is a nozzle receiving opening; and said pump includes a dispensing nozzle projecting through said nozzle receiving opening when said dispensing unit is supported on said base and said cover is in closed position.

4. The dispensing combination of claim 3, wherein said cover has a forward face having a lower surface area and an upper surface area disposed at an acute angle with respect to the plane of said lower surface area; said nozzle receiving opening being located in said upper surface area; and said pump is disposed in a plane substantially parallel to the plane of said upper surface area.

5. The dispensing combination of claim 4, wherein said base has a main body portion lying in a plane substantially parallel to that of said lower surface area of said cover when said cover is in closed position; guide means are disposed on said base and projecting in a plane substantially parallel to the plane of said upper surface area; said dispensing unit being supported on said guide means.

6. The dispensing combination of claim 2, wherein locating means are mounted in said base; said pump being engaged by said locating means when said dispensing unit is supported on said base.

7. The dispensing combination of claim 1, wherein said base has an access opening in its bottom surface in opposed relationship with said second access opening in said cover.

8. The dispensing combination of claim 1, wherein latch means are carried by said base and said cover to releasably retain said cover in closed position.

9. The dispensing combination of claim 1, wherein means are removably disposed on said base for limiting movement of said dispensing unit relatively thereof.

10. The dispensing combination of claim 1, wherein the part of said reservoir portion of said dispensing unit which projects through said second access opening is visually and manually accessible from the bottom of said mounting unit.

* * * * *

UNITED STATES PATENT AND TRADEMARK OFFICE

CERTIFICATE OF CORRECTION

PATENT NO. : 4,765,515

DATED : August 23, 1988

INVENTOR(S) : Jerome Lippman

It is certified that error appears in the above-identified patent and that said Letters Patent are hereby corrected as shown below:

In Column 4, Line 51, delete "53 into the" and substitute therefor --access--.

Signed and Sealed this

Fourteenth Day of February, 1989

*Attest:*

DONALD J. QUIGG

*Attesting Officer*

*Commissioner of Patents and Trademarks*